United States Patent [19]

Lindhal

[11] Patent Number: 4,938,843

[45] Date of Patent: Jul. 3, 1990

[54] METHOD FOR PRODUCING IMPROVED HIGH-YIELD PULPS

[75] Inventor: Jonas A. I. Lindhal, Domsjo, Sweden

[73] Assignee: Mo och Domsjo Aktiebolag, Ornskoldsvik, Sweden

[21] Appl. No.: 703,240

[22] Filed: Feb. 20, 1985

[30] Foreign Application Priority Data

Feb. 22, 1984 [SE] Sweden ..... 8400969

[51] Int. Cl.[5] ..... D21D 5/02

[52] U.S. Cl. ..... 162/55; 162/149

[58] Field of Search ..... 162/24, 55, 4, 19, 56, 162/DIG. 11, 10, 149

[56] References Cited

U.S. PATENT DOCUMENTS

| | | | |
|---|---|---|---|
| 4,029,543 | 6/1977 | Lindahl | 162/24 |
| 4,247,363 | 1/1981 | Soma et al. | 162/56 |
| 4,444,621 | 4/1984 | Lindahl | 162/56 |
| 4,502,918 | 3/1985 | Mackie et al. | 162/24 |

FOREIGN PATENT DOCUMENTS

| | | | |
|---|---|---|---|
| 200626 | 5/1983 | Fed. Rep. of Germany | 162/55 |

OTHER PUBLICATIONS

Jackson et al., "Factors Limiting the Strength Characteristics of Thermomechanical Pulp", *Transactions*, (Sep. 1980), pp. 65–72.

*Primary Examiner*—Peter Chin

[57] ABSTRACT

Improved chemimechanical, particularly chemithermomechanical, pulp (CTMP), is produced by defibrating or refining wood chips to produce pulp, and then screening the pulp and separating out at least 30% by weight of the incoming fiber suspension as a first long-fiber fraction, and also separating out a first fine-fiber fraction, screening the first fine fiber fraction a second time, and separating out a second long-fiber fraction which is combined with the first long-fiber fraction to form a long-fiber fraction of improved properties, and a second fine-fiber fraction of improved properties.

8 Claims, 1 Drawing Sheet

METHOD FOR PRODUCING IMPROVED HIGH-YIELD PULPS

Figure 1:
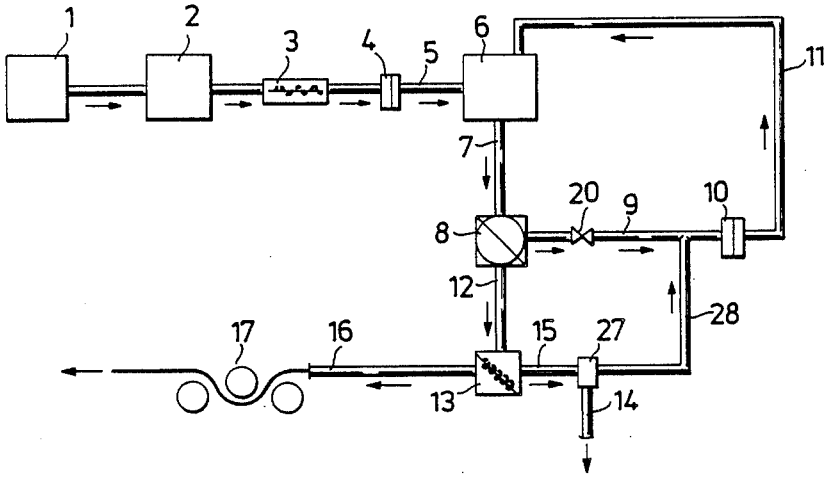

High-yield pulps are defind as pulps obtained in a yield of from 65 to 95% of the original weight of the wood. Examples of such pulps are refiner mechanical pulp, thermomechanical pulp, and chemimechanical pulp. A type of chemimechanical pulp is chemithermomoechanical pulp (CTMP).

In the manufacture of chemimechanical pulp, wood chips are first impregnated with digestion chemicals and then heated to high temperatures (pre-cooking). This treatment results in a yield of between about 65% and about 95% calculated on the weight of the charged wood. The pre-cooked chips are then defibrated in a disc refiner, usually in a series of two disc refiners. The resultant pulp is not fully defibrated, and contains fiber-knots and shives. Shives are normally defined as particles unable to pass through a laboratory screening plate having a slot-width of 0.15 mm.

To separate shives from the pulp fibers, the pulp is diluted with large quantities of water to a pulp consistency normally within the range from 0.5 to 3%. The fiber suspension (injects flow) is normally screened by, for example, a centrifugal screen, where the fiber suspension is separated into an accepts flow which is cleaner than the injects flow, and a rejects flow which contains more shives. The accepts flow is passed to a vortex cleaner for further cleaning. The rejects obained in the centrifugal screen and the vortex cleaner is recycled to a disc refiner, and there defibrated and refined to pulp fibers. Normally, these fibers are screened again in a centrifugal screen. The accepts from the centrifugal screen and the vortex cleaners are passed to a wet machine or to a paper machine, if desired, after having been bleached.

When producing thermomechanical pulp, pre-heated wood chips are defibrated in a disc refiner, and when producing chemithermomechanical pulp, heated chips impregnated with chemicals are defibrated in a disc refiner.

High-yield pulps can be used for all manner of products in which pulp fibers constitute an essential ingredient, including, for example, fluff pulp for the manufacture of adsorbent products, and pulp for paperboard, newsprint, and other types of printing paper and tissue paper. In the manufacture of printing paper, the shive content must be quite low, and the pulp must provide a paper of low roughness and high opacity. However, a serious problem with high-yield chemimechanical pulps is that they give paper products that have a high roughness and relatively low opacity. One such chemimechanical pulp is chemithermomechanical pulp (CTMP), which is normally obtained in pulp yields of from 92 to 95%. The manufacture of CTMP for printing paper consumes large amounts of electricity. The electricity consumption to produce one ton of pulp with a freeness of about 100 ml Canadian Standard Freeness (CSF) may reach 2 to 2.5 MWh. Despite a high electrical energy input when refining the pulp in one or several disc refiners, CTMP gives a paper surface layer that is worse than that obtained with chemical pulp or groundwood pulp.

The method of the present invention overcomes these difficulties and at a low energy consumption provides a practically shive-free high-yield pulp characterizable as a chemimechanical pulp. The pulp provides a paper of uniform quality, low surface roughness, and high opacity, suitable for producing LWC paper (LWC=Light Weight Coated), and for admixing with other printing papers when a high demand is placed on quality. The method according to the invention provides chemimechanical high-yield pulps, e.g. CTMP, having specific properties on a par with groundwood pulp.

In addition to these advantages, the invention provides a long-fiber pulp of low resin content and low pulp density (high bulk) that is extremely well suited for conversion to absorption products, e.g. diapers. The manufacture of such products requires a pulp of high bulk, high absorption rate and high absorption capacity, i.e., high liquid take-up. This long-fiber pulp is also suitable for use as a starting material in the manufacture of paperboard and tissue paper.

The invention also provides, as a separate product, a fine fiber pulp of low shive content and uniform fiber distribution, useful in making high quality uniform printing paper of low surface roughness, and high tensile index, and showing improved forming properties.

The process of the present invention thus produces improved high-yield pulps of the chemimechanical or chemithermomechanical type and comprises screening defibrated or refined pulp in a first screening stage; separating out at least 30% by weight of the fiber content of the defibrated or refined pulp as a long-fiber fraction; and also separating out a further portion of the fiber content as a first fine-fiber fraction; screening the first fine-fiber fraction in a second screening stage and separating out a second long-fiber fraction and a second fine-fiber fraction; combining first and the second long-fiber fractions to form an improved long-fiber fraction; dewatering and recovering the long-fiber fraction; dewatering the second fine-fiber fraction and recovering the second fine-fiber fraction.

In accordance with the invention, a particular advantage is afforded when the fiber compositions of the first and second long-fiber fractions and the second fine-fiber fraction that are separated out are maintained substantially constant, and independent of the fiber composition of the starting defibrated or refined pulp. This can be done by adjusting the area of the openings in the first screening stage and/or by controlling the flows from the first screening stage. Preferably, the process is so controlled that from 0 to 15% of the fibers of the combined first and second long-fiber fractions pass through a Bauer McNett screen having 59 openings/cm (150 mesh), and from 30 to 60%, preferably from 35 to 45%, of the fibers of the second fine-fiber fraction pass through a Bauer McNett screen having 59 openings/cm (150 mesh).

According to the invention, defibration, refining and screening can be so controlled that the fine-fiber fraction has a shives content not exceeding from 0.01 to 0.05%.

The rejects pulp flow from the first screening stage is suitably so controlled in relation to the freeness of the unscreened pulp that a larger amount of rejects is taken out from pulps of high freeness than from pulps of low freeness. It has been found particularly advantageous to take out at least 40% by weight of the unscreened pulp as rejects in the first screening stage, when the pulp has a freeness above 400 ml CSF, and to take out at least 30% by weight of the unscreened pulp as rejects pulp in the first screening stage when the pulp has a freeness below 400 l ml CSF.

Preferably, the second long-fiber fraction obtained in the second screening stage comprises 5 to 20% by weight of the total amount of incoming pulp suspension.

Figure 2:
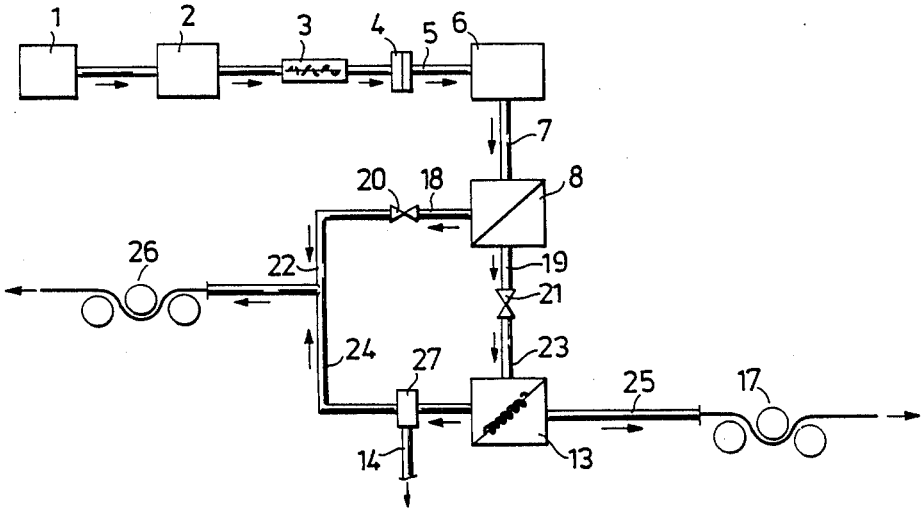

FIG. 1 is a flow sheet showing the stages in the manufacture of high-yield pulp in accordance with the known prior art; and FIG. 2 is a flow sheet showing the stages in the manufacture of high-yield pulp in accordance with a preferred embodiment of the invention.

As shown in FIG. 1, wood chips are impregnated with chemicals such as $NaHSO_3/Na_2SO_3$ in a vessel 1 (impregnation stage). When CTMP is produced, the amount of $NaHSO_3/Na_2SO_3$ charged to the system is about 2%, calculated on the wood dry weight. The impregnated chips are heated to a temperature of about 130° C. in a vessel 2 (digestion stage). After being held for 3 to 10 minutes in the vessel 2, the chips are transferred by screw conveyor 3 to the defibration stage, where the chips are defibrated in a defibrating means 4 (such as a disc refiner), where the energy input is approximately 1000 kWh per ton of dry pulp. The pulp is normally processed in a second defibration stage, such as a disc refiner (not shown). After passing the defibrator 4, the pulp consistency is normally 20 to 40%. The freeness of the pulp varies between 100 and 700 ml CSF, and its shives content between about 0.2 and about 2%.

It is necessary to screen the pulp in order to separate the shives and, to a certain extent, also fiber knots (bundles of 2 to 4 fibers) therefrom. Accordingly, the pulp is passed through a conduit 5 to a vessel 6, where it is diluted with water, and the pulp consistency adjusted to about 2%. The pulp suspension is then passed through a conduit 7 to a first screening stage where closed screening means 8 (centrifugal screen) operating at superatmospheric pressure screens the pulp, separating it into accepts and rejects fractions. Other screening means can be used such as a centrifugal screen which operates at atmospheric pressure, or a curved screen.

The rejects pulp not passing through the screen 8 is passed through conduit 9 to a further defibrating means 10 (a disc refiner) in which the shives and fiber-bundles are defibrated into single fibers. Fiber suspension exiting from the defibrator 10 is passed through conduit 11 to the vessel 6 so that it can be rescreened in the screen 8.

The accepts pulp passing through the screen 8 proceeds through conduit 12 to a second screening stage where the screen 13, for example a vortex cleaner, further purifies the pulp. In addition to shives, impurities such as bark and sand particles are separated from the suspension in an apparatus 27. The impurities is discharged from the system through the conduit 14.

The fiber rejects exiting from the vortex cleaners is passed through conduits 15 and 28 to the disc refiner 10, and there defibrated together with the rejects obtained from the screen 8. Normally, the total amount of rejects pulp charged to the disc refiner 10 is about 20% by weight of the fiber suspension passed through the conduit 7. The energy consumed when processing the fiber rejects in the disc refiner 10 is from 500 to 1200 kWh per ton of pulp.

The accepts obtained from the vortex cleaners is passed through the conduit 16 to the paper machine or the wet machine 17, optionally after having been bleached.

As shown in FIG. 2, in manufacturing CTMP in accordance with the invention the chips and the resultant pulp are treated in a similar manner to FIG. 1 up to the first screening stage 8. The fiber suspension in the vessel 6 has a pulp consistency of from 0.5 to 6.0%, preferably from 0.8 to 3.0%. The fiber suspension is passed through the conduit 7 to a first screening stage, where a closed or open centrifugal screen 8 separates the pulp into a first long-fiber fraction, which is the rejects taken out through conduit 18, and a first fine-fiber fraction, which is the accepts, taken out through the conduit 19. This fractionation of the fiber suspension can also be effected with other screening means, such as a curved screen for example. In this stage, the areas of the holes or slots in the screen 8 and/or the flows exiting therefrom in the conduits 18 and 19 are so adjusted and controlled that the long-fiber fraction rejects and the fine-fiber fraction accepts have a substantially constant fiber composition.

The fiber distribution in the long-fiber fraction and fine-fiber fraction, respectively, is dependent upon the freeness of the fiber suspension passed to the screening stage through the conduit 7. Thus, when the freeness of the fiber suspension is 400 ml or higher, at least 40% by weight, and preferably at least 50% by weight, of a total pulp flow is taken out as long-fiber fraction (rejects). When the fiber suspension has a freeness which is lower than 400 ml, at least 30% by weight of the total fiber-suspension flow is taken out as long-fiber fraction. The desired take-out of each fraction is effected by suitable adjustment of the slot or hole size in the screen.

The desired pulp quantities can also be controlled by changing the pulp consistency of the injects pulp in the conduit 7. It is also possible to control, to a certain extent, the percentage of pulp of respective qualities by adjusting the valve 20 and/or the valve 21, for example.

The long-fiber fraction rejects in the conduit 18 pass through conduit 22 to a wet machine or paperboard machine 26, optionally after being bleached.

The fine-fiber fraction accepts in the conduit 19 is passed through a conduit 23 via the valve 21 to a second screening stage in the form of the vortex cleaner 13.

A selected quantity of the second long-fiber fraction is removed from the vortex cleaners through a conduit 24, and the second fine-fiber fraction is removed through a conduit 25. The percentage of long-fiber fraction removed is from 5 to 20% by weight of the total amount of pulp in the fiber suspension passed through the conduit 23 to the vortex cleaners. The second long-fiber fraction is passed through the conduit 24 to a wet machine or paperboard machine 26, optionally after having been bleached.

The fine-fiber fraction is passed through the conduit 25 to the wet machine or paper machine 17, optionally after having been bleached.

The fine-fiber fraction taken out through the conduit 25 in accordance with the invention has an extremely low shives content, within the range of from 0.01% to 0.05%. When fractionating in accordance with Bauer McNett, the fine-fiber fraction has a fiber composition which is markedly different from the fiber composition of known pulps of corresponding type (CTMP) at comparable freeness. The fine-fiber fraction contains at least 30% fibers which, in accordance with Bauer McNett, pass through a wire having 59 openings/cm (150 mesh). A fine-fiber fraction of such fiber composition provides a printing paper of low surface roughness, resulting in uniform pigment absorption and high opacity, in comparison with papers produced from a conventional chemimechanical pulp, such as CTMP. It is even fully comparable with groundwood pulp especially produced for use in the manufacturing of printing paper.

The long-fiber fraction, which is collected through the conduits 22 and 24, has a high freeness (200 to 750 ml CSF) and a low resin content, below 0.3% DKM (subsequent to being bleached, beneath 0.15% DKM) and comprises 85 to 100% fibers which are retained on a Bauer McNett screen having 59 openings/cm (150 mesh). This fraction is extremely well suited as a starting material in the manufacture of absorption products, and provides a high bulk, good absorption rate, and an extremely high absorption capacity.

Thus, the method in accordance with the invention makes it possible to produce instead of a single chemimechanical pulp at least two products each of which possesses extremely good properties, and this at a lower energy consumption, since the total amount of energy consumed in respect of the long-fiber fraction in the conduit 18 in accordance with the invention is 400 to 600 kWh/ton of dry pulp, while the energy consumption in respect of conventional CTMP pulp of corresponding quality is approximately 1000 kWh/ton of dry pulp. The energy consumed when manufacturing the fine-fiber fraction in the conduits 19 and 25 is 1800 to 2000 kWh/ton of dry pulp, while corresponding values in respect of conventional CTMP of corresponding quality is approximately 2300 kWh/ton of dry pulp.

The long-fiber fraction produced in accordance with the invention is highly suited for admixture with other pulps, such as sulphite pulp and sulphate pulp. The said fraction is also extremely well suited as a starting material in the manufacture of paperboard and absorption products. Other fiber materials such as waste paper, peat fibers and synthetic fibers, can also be admixed with the long-fiber fraction.

The following Examples represent preferred embodiments of the invention.

EXAMPLE 1

Approximately 10 tons of chemimechanical spruce pulp, CTMP, were produced in a pilot plant in accordance with the prior art as shown in FIG. 1, transported to a mill, and screened. The screened pulp was bleached with peroxide, and then used to manufacture paper on an experimental paper machine. The spruce wood was chipped in a chipper to pieces having a length of 30 to 50 mm, a width of 10 to 20 mm and a thickness of 1 to 2 mm, and the chips were transported to the vessel 1 (see FIG. 1) by means of a screw feeder. The vessel was filled with a sodium sulphite solution having a pH of 7.5. The sulphur dioxide content was 5 g/l, and the sodium hydroxide content was 6.5 g/l. During the impregnation stage, the chips absorbed on average 1.1 liters of sulphite solution per kilogram of dry chips. Thus, the amount of sulphur dioxide absorbed was $1.1 \times 5 = 5.5$ g/kg of chips, or 0.55%. The impregnation chamber 1 was maintained at a temperature of 132° C., and the total retention time of the chips was about 2 minutes. The wood material was weakly sulphonated during its retention time in the vessel 1.

The impregnated chips were passed to the vessel 2 (digester stage), where saturated steam was charged to bring the temperature to 132° C., and retained there 4 minutes. Thus, taking into account the retention time for the chips in the impregnation chamber, the total sulphonation time was 6 minutes.

The chips were taken out from the bottom of the digester section 2, and transported via the screw transporter 3 to the disc refiner 4, where the chips were defibrated and refined to produce a finished pulp. The solids content at the center of the disc refiner was 30%, while the pulp consistency at the periphery of the discs was 32%. The energy input during the defibration process was measured at 1850 kWh per ton of bone-dry pulp produced.

The defibrated pulp was blown into a cyclone (not shown), in which surplus steam was separated from the pulp fibers. The pulp fibers were collected in carriers which were emptied into trucks, which then transported the pulp to a mill in which the pulp was further processed. Upon arrival at the mill, the pulp was tipped into the vessel 6, a pulper, where the pulp was diluted with water to a pulp consistency of 1.2%. Measurements showed that the pulp had a freeness of 165 ml CSF. The resultant fiber suspension was passed through the conduit 7 to the pressurized screen 8, provided with a stationary cylindrical screening basket, the fiber suspension being fed to the inner cylindrical surface of said basket at superatmospheric pressure. The screen was provided with an internal rotating and pulsating scraper. The openings in the perforated screening plates of the pressurized screen had a diameter of 2.1 mm. The flow of fiber suspension to the pressure screen was controlled so that 15% by weight of the fiber content of the fiber suspension supplied remained on the screening plates, and was passed further, as a rejects pulp, via the valve 20 through the conduit 9 to the disc refiner 10, for further treatment. The pulp treated in the disc refiner was passed through the conduit 11 to the pulper 6.

The accepts obtained in the pressurized screen 8 had a pulp consistency of 1.0%, and was taken out through the conduit 12 and further purified in the vortex cleaners 13. The accepts pulp obtained in the vortex cleaners was passed to the wet machine 17 via the conduit 16. The rejects pulp in the conduit or line 15 comprised up to 10% of the ingoing pulp, and was further cleaned in vortex cleaners (not shown), whereupon undesirable impurities such as sand and bark were separated from the pulp in the apparatus 27, and dumped via the conduit 14. Purified rejects pulp was passed through the conduit 28 to the rejects refiner 10. A sample, designated Example 1, was taken from the pulp on the wet machine 17, in order to determine freeness and fiber composition, and to analyse the paper's technical properties.

EXAMPLE 2

The process for manufacture of CTMP of Example 1 was modified by reducing the energy input in the defibrating and refining stage in the disc refiner 4 from 1850 kWh/ton of pulp to merely 900 kWh/ton. The result was a coarse pulp having a freeness of 570 ml CFS. The pulp was transported in trucks to a mill for further processing, and charged to the vessel 6 (see FIG. 2). Pulp suspension having a pulp consistency of 0.95% was passed from the pulper 6 through the conduit 7 to the pressurized screen 8, the screening plates of which had been changed for plates having an opening diameter of 1.9 mm instead of the opening diameter of 2.1 mm of the previous plates. At the same time, the opening of the valve 21 was reduced and the valve 20 was opened to a greater extent than in the former case, so that the amount of rejects pulp in the conduit or line 18—the first long-fiber fraction—rose to 50% by weight of the fiber content of the incoming fiber suspension. The long-fiber fraction had a freeness of 670 ml. This fraction was passed to the wet machine 26, via the conduit 18, the valve 20 and the conduit 22.

The accepts pulp obtained in the pressurized screen 8—the first fine-fiber fraction—was passed to the vortex cleaners 13, via the conduit 19, the valve 21 and the conduit 23. The pulp consistency of the fine-fiber fraction in the conduit 23 was 0.70%.

The amount of rejects pulp in the vortex cleaners—the second long-fiber fraction—rose to 8% of the total amount of fibers entering the vortex cleaners. This pulp was passed through the conduit 24 to the wet machine 26, and mixed immediately upstream thereof with the long-fiber fraction conveyed through the conduit 22. From the resultant pulp mixture there was taken a sample designated Example 2A. This sample was analysed for its absorption properties.

Prior to passing the rejects pulp fraction in the conduit 24 to the wet machine, the fraction was purified in a further vortex cleaner stage 27, whereupon sand and bark particles were discharged through the effluent conduit 14, for transport to a purifying department.

The accepts pulp obtained in the vortex cleaners 13—the second fine-fiber fraction—was passed through the conduit 25 to the wet machine 17, from which samples were taken for evaluation as Example 2B.

EXAMPLE 3

In this Example, the electrical energy input to the refiner 4 was 1300 kWh/ton. This electrical energy consumption resulted in a pulp having an ultimate freeness of 325 ml CSF. The pulp was transported for further processing to the same mill as that referred to in the previous Examples. The pulp suspension obtained in the pulper 6 had a pulp consistency of 0.95%, and was passed through the conduit 7 to the pressurized screen 8, the screening plates of which had an opening diameter of 1.9 mm. Compared with the screening of Example 2A and 2B, the opening of the valve 21 was reduced so that the amount of rejects pulp was 35% of the total amount of fiber in the pressure screen. The long-fiber fraction obtained in the conduit 18 then had a freeness of 660 ml CSF. This fraction was passed to the wet machine 26 via the conduit 18, the valve 20 and the conduit 22, this machine having the form of a screw press both in the case of Example 2A and the long-fiber fraction. The accepts pulp obtained in the pressurized screen 8 was passed to the vortex cleaners 13 via the conduit 19, the valve 21 and the conduit 23. The pulp consistency of the fiber suspension entering the vortex cleaners was 0.75%. The amount of rejects pulp reached 9% of the total amount of fibers entering the vortex cleaners, this pulp being passed to the wet machine 26 via the conduit 24. The pulp was mixed immediately upstream of the wet machine with the long-fiber fraction supplied through the conduit 22. A sample designated Example 3A was taken from the resultant pulp mixture and analysed with respect to its absorption properties. Before being passed to the wet machine, the rejects pulp corresponding to Example 3A obtained in the vortex cleaners 13, was purified in a further vortex cleaner stage 27, whereupon sand and bark particles were discharged to a waste outlet and a purifying plant through the conduit 14. The accepts pulp obtained in the vortex cleaners 13 was passed to the wet machine 17 through the conduit 25. A sample, Example 3B, was taken from this machine for evaluation.

All of the samples were bleached with hydrogen peroxide, washed with water, and dried to a dry solids content of 90%. The freeness, shives content, fiber composition and optical properties of the bleached pulps are shown in Table I below.

TABLE I

| Example No. | 1 | 2A | 2B | 3A | 3B |
|---|---|---|---|---|---|
| Starting pulp freeness CSF ml[1] | 165 | 570 | 570 | 325 | 325 |
| Sample freeness CSF ml | 130 | 645 | 120 | 630 | 110 |
| Shive content, Sommerville % | 0.06 | 0.28 | 0.02 | 0.23 | 0.01 |
| Fiber composition according to Bauer McNett[2] | | | | | |
| +7.9 openings/cm (+20 mesh), % | 41.0 | 61.7 | 23.0 | 60.3 | 20.2 |
| +59 openings/cm (+150 mesh), % | 33.0 | 30.5 | 43.0 | 31.5 | 42.8 |
| −59 openings/cm (−150 mesh), % | 26.0 | 7.8 | 34.0 | 8.2 | 37.0 |
| Brightness, ISO[3], % | 76.3 | 74.2 | 77.0 | 74.8 | 77.5 |

[1]According to SCAN-C 21:65
[2]According to SCAN-M 6:9
[3]According to SCAN-C 11:75

As seen from the Table, the long-fiber fractions (Examples 2A and 3A), have a uniform fiber-composition distribution, irrespective of the freeness of the starting pulp. The fiber distribution in the fine-fiber fractions (Examples 2B and 3B) is also surprisingly uniform. In addition, the fine-fiber fractions have a surprisingly low shives content (slot width 0.15 mm in the Sommerville-screen).

The dried samples Examples, 1, 2A and 3A were disintegrated in disc refiners to obtain a fluff pulp. These samples were examined to determine their bulk, absorption rate and absorption capacity. The results obtained are set forth in Table II; the Control was a chemical pulp, sulphate pulp.

TABLE II

| Example | Bulk ($cm^3/g$[1]) | Absorption[1] (sec) | Absorption[1] ml/g |
|---|---|---|---|
| 1 | 14.9 | 7.1 | 9.7 |
| 2A | 20.2 | 7.4 | 10.5 |
| 3A | 20.7 | 8.1 | 10.7 |
| Control | 18.1 | 6.7 | 10.3 |

[1]According to SCAN-C 33:80

It is seen from Table II that the long-fiber fractions 2A and 3A produced in accordance with the invention had extremely high bulk values, irrespective of the freeness of the starting pulp. The Examples also exhibited an extremely good adsorption rate and absorption capacity.

The Examples 1, 2B and 3B were dissolved in water and paper was produced from the fiber suspension and the technical properties of the paper evaluated. The results are set forth in Table III.

TABLE III

| Example No. | 1 | 2B | 3B |
|---|---|---|---|
| Tensile Index, Nm/g | 37.5 | 41.5 | 43.7 |
| Tear Index, mN $m^2/g$ | 7.6 | 5.9 | 5.8 |
| Light scattering coefficient, $m^2/g$ | 41.6 | 58.0 | 59.5 |
| Opacity, % | 81.2 | 89.0 | 89.3 |
| Roughness, Bendtsen, ml/min | 350 | 200 | 195 |
| Forming index | 5.5 | 10.0 | 10.0 |

As seen from Table III, the pulps 2B and 3B of relatively high fine-fiber material content produced in accordance with the invention had a high tensile index. The high light scattering coefficient and opacity of these pulps was particularly advantageous. The low roughness of the paper is another property of particular value when manufacturing high quality printing paper.

As seen from Table III, Examples 2B and 3B also resulted in greatly improved forming properties (given as the Forming Index in Table III). One surprising feature is that the method according to the invention resulted in a paper of unexpected uniform quality, despite the varying degrees of freeness of the starting pulps.

When practicing the method according to the invention it is possible, by producing pulp from wood chips in disc refiners, to produce improved products for widely different purposes, such as pulp for the manufacture of high-grade printing paper, and pulp for the manufacture of fluff and paperboard, at lower than normal electrical energy consumption.

Having regard to the foregoing disclosure the following is claimed as the inventive and patentable embodiments thereof:

1. A process for preparing improved high-yield cellulose pulps of the chemimechanical or chemithermomechanical type, consisting essentially of screening defibrated cellulose pulp in a first screening stage while controlling at least one of the area of the openings and the flows from the first screening stage so as to separate out as rejects not passing through the screen a long fiber fraction and as accepts passing through the screen a fine fiber fraction; separating out at least 30% by weight of the fiber content of the defibrated pulp as a long-fiber fraction comprising from 85 to 100% long fibers which are retained on a Bauer McNett screen having 59 openings per centimeter (150 mesh); and also separating out a further portion of the fiber content as a first fine-fiber fraction comprising at least 30% fibers which in accordance with Bauer-McNett pass through a wire having 59 openings per centimeter (150 mesh); screening the first fine-fiber fraction in a second screening stage and separating out a second long-fiber fraction comprising from 85 to 100% long fibers which are retained on a Bauer-McNett screen having 59 openings per centimeter (150 mesh) and a second fine-fiber fraction comprising at least 30% fibers which in accordance with Bauer McNett pass through a wire having 59 openings per centimeter (150 mesh); combining first and the second long-fiber fractions to form an improved long-fiber fraction; dewatering and recovering the long-fiber fraction; dewatering the second fine-fiber fraction and recovering the second fine-fiber fraction.

2. A process according to claim 1 which comprises maintaining substantially constant the fiber compositions of the first and second long-fiber fractions and the second fine-fiber fraction that are separated out and independent of the fiber composition of the starting defibrated pulp.

3. A process according to claim 2 in which this is done by adjusting the area of the openings in the first screening stage.

4. A process according to claim 2 in which this is done by controlling the flows from the first screening stage.

5. A process according to claim 1, so controlled that from 0 to 15% of the fibers of the combined first and second long-fiber fractions pass through a Bauer McNett screen having 59 openings/cm (150 mesh), and from 30 to 60% of the fibers of the second fine-fiber fraction pass through a Bauer McNett screen having 59 openings/cm (150 mesh).

6. A process according to claim 1, so controlled that the fine-fiber fraction has a shives content not exceeding from 0.01 to 0.05%.

7. A process according to claim 1, in which the rejects pulp flow from the first screening stage is so controlled in relation to the freeness of the unscreened pulp that at least 40% by weight of the unscreened pulp is taken out as long fiber fraction in the first screening stage, when the pulp has a freeness above 400 ml CSF, and at least 30% by weight of the unscreened pulp is taken out as long fiber fraction in the first screening stage when the pulp has a freeness below 400 ml CSF.

8. A process according to claim 1 in which the second long-fiber fraction obtained in the second screening stage comprises from 5 to 20% by weight of the total amount of incoming pulp suspension.

* * * * *